US006012241A

United States Patent [19]

Pasienski et al.

[11] Patent Number: 6,012,241

[45] Date of Patent: Jan. 11, 2000

[54] CHAIN TRENCHER HAVING HEAD SHAFT WEAR PLATES

[75] Inventors: Stanley W. Pasienski, Colleyville; John Gilbert, Southlake, both of Tex.

[73] Assignee: Trencor, Inc., Grapevine, Tex.

[21] Appl. No.: 09/179,293

[22] Filed: Oct. 27, 1998

[51] Int. Cl.[7] ..... E02F 3/14

[52] U.S. Cl. ..... 37/465; 37/352; 299/82.1; 30/383

[58] Field of Search ..... 37/462, 463, 464, 37/465, 189, 352, 353, 354, 355, 362; 30/381, 383, 384, 385; 299/82.1, 83.1, 84.1

[56] References Cited

U.S. PATENT DOCUMENTS

| | | | |
|---|---|---|---|
| 1,766,052 | 6/1930 | Bettin | 37/465 X |
| 3,235,102 | 2/1966 | Chapman | 37/465 X |
| 3,315,384 | 4/1967 | Weyers | 37/464 X |
| 3,754,341 | 8/1973 | Caldwell et al. | 30/383 X |
| 4,217,001 | 8/1980 | Youngers et al. | 299/82.1 |
| 4,223,462 | 9/1980 | Morris | 37/191 A |
| 4,404,761 | 9/1983 | Paulin et al. | 37/191 A |
| 4,429,477 | 2/1984 | Tice et al. | 299/82.1 X |
| 4,445,878 | 5/1984 | Linke et al. | 299/82.1 X |
| 4,492,030 | 1/1985 | Beerens | 30/384 |
| 4,765,072 | 8/1988 | Schroeder | 37/465 |
| 4,768,289 | 9/1988 | Apfel et al. | 30/383 |
| 4,974,348 | 12/1990 | Wallace | 37/465 |
| 5,199,197 | 4/1993 | Thuerman | 37/465 |
| 5,471,771 | 12/1995 | Gilbert | 37/352 |
| 5,655,304 | 8/1997 | Apfel et al. | 30/383 |
| 5,930,923 | 8/1999 | Nishiguchi | 37/465 X |

*Primary Examiner*—Victor Batson
*Attorney, Agent, or Firm*—Locke Liddell & Sapp LLP

[57] ABSTRACT

An excavating machine includes a main frame, an endless digging chain, and a boom. The boom is mounted to the main frame and is adapted to carry the digging chain. The boom includes an upper surface, a lower surface, an inner end and outer end. The surfaces are adapted to slidably engage the chain. A drive sprocket is mounted to the main frame and is disposed at the inner end of the boom for engaging the chain. A wear plate is mounted to the boom and is disposed between the drive sprocket and the inner end of the boom for slidably engaging the chain between the drive sprocket and the upper surface of the boom inner end.

4 Claims, 2 Drawing Sheets

CHAIN TRENCHER HAVING HEAD SHAFT WEAR PLATES

TECHNICAL FIELD OF THE INVENTION

The present invention relates to excavating equipment, and more particularly to a chain trencher having a boom carrying a digging chain having head shaft wear plates.

BACKGROUND OF THE INVENTION

Digging deep excavations, such as cross-country ditches necessitates that a considerable amount of material be removed from the ground in order to provide a ditch bottom which is constructed at a specific elevation or grade. Construction of deep ditches and other excavations usually requires a machine having a ladder type digging apparatus that translocates excavated material from the ditch using a lower run of the digging member, up through a throat and then along a lateral conveyor to a location spaced from the excavating machine. Typically, such excavating machines include a boom carrying a digging chain. The chain is driven by a sprocket located near or on the inner end of the boom, and may be in sliding engagement with one or both surfaces of the boom.

A portion of the digging chain, during a digging operation, comes in contact with surfaces of the boom, causing excessive wear on the boom. To accept wear caused by the friction associated with the digging chain, wear plates have been arranged on the boom. The ware plates are usually installed on the underside of the boom and are illustrated in U.S. Pat. Nos. 4,223,462 and 5,471,771.

Booms also experience excessive wear on the top boom surface adjacent to the inner end of the boom. The transition of the chain from the sprocket at the inner end of the boom, to the boom top surface creates a high wear area at the inner end of the boom top surface. Additionally, in this area, slack is introduced into the chain, and the chain impacts the top surface of the boom resulting in considerable "popping sound" noise being generated. A need has thus arisen for structure to improve the transition of a digging chain at the inner end of a boom as the chain rotates off of the driving sprocket.

SUMMARY OF THE INVENTION

In accordance with the present invention, an excavating machine includes a main frame, an endless digging chain, and a boom. The boom is mounted to the main frame and is adapted to carry the digging chain. The boom includes an upper surface, a lower surface, an inner end and outer end. The surfaces are adapted to slidably engage the chain. A drive sprocket is mounted to the main frame and is disposed at the inner end of the boom for engaging the chain. A wear plate is mounted to the boom and is disposed between the drive sprocket and the inner end of the boom for slidably engaging the chain between the drive sprocket and the upper surface of the boom inner end.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
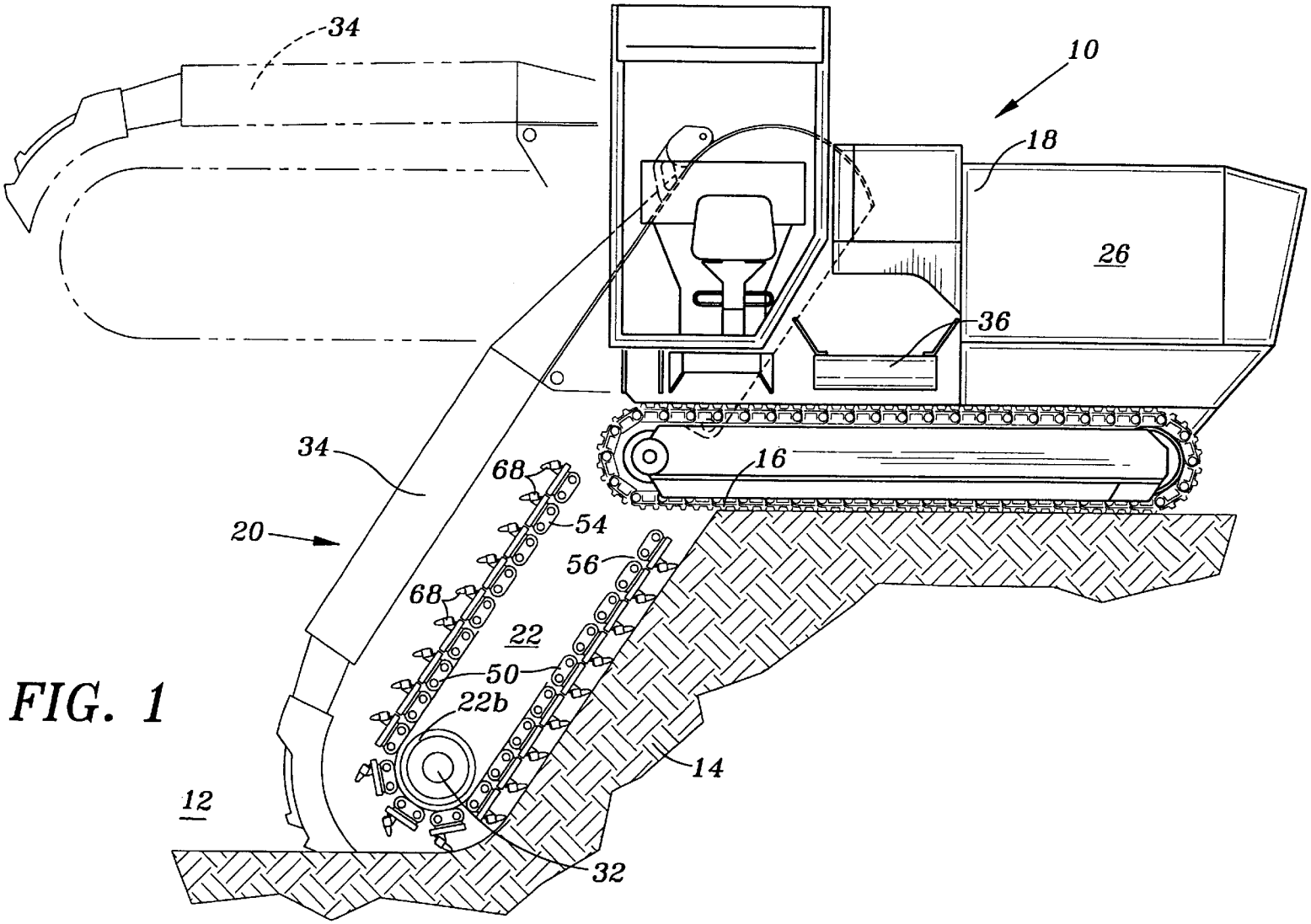
FIG. 1 is a side elevational view of a digging machine in accordance with the present invention.
Figure 2:
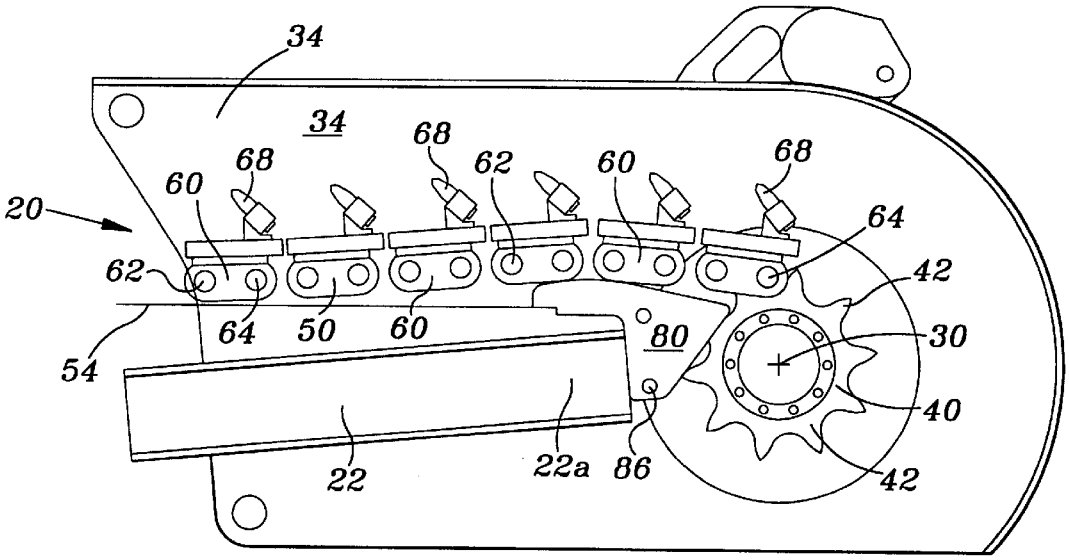
FIG. 2 is an enlarged side elevational view of the present boom, chain driving sprociket, and wear plates of the present invention.

Referring to FIGS. 1 and 2, a digging machine is illustrated and is generally identified by the numeral 10. Digging machine 10 may be utilized for digging a ditch 12 into ground 14. Excavating machine 10 is supported on a set of tracks 16, and includes a main frame 18. Attached to main frame 18 is an endless digging apparatus, generally identified by the numeral 20. Digging apparatus 20 includes a main support boom 22 having an inner end 22*a* and an outer end 22*b*. End 22*a* is attached to and extends from the trailing end of main frame 18. Excavating machine 10 includes a prime mover 26, preferably located at the forward end of main frame 18 for propelling excavating machine 10 along ground 14 and for powering endless digging apparatus 20.

Hydraulic cylinders (not shown) are interconnected between boom 22 and main frame 18 to pivotally mount endless digging apparatus 20 for movement within a vertical plane. A head shaft 30 pivotally connects the inner end 22*a* of boom 22 to main frame 18. A tail shaft 32 is mounted at outer end 22*b* of boom 22.

Excavating machine 10 further includes a combination support and shield 34 which partially encloses boom 22 and digging apparatus 20 there within. Main frame 18 further includes a lateral conveyor 36 for transporting material excavated by endless digging apparatus 20 to a location spaced from boom 22.

Referring simultaneously to FIGS. 1 and 2, boom 22 is pivotally mounted to head shaft 30 which is mounted to main frame 18. Also mounted to head shaft 30 is a sprocket 40 having a plurality of teeth 42. Endless digging apparatus 20 includes a chain 50 which meshes with sprocket 40 and tail shaft 32. Prime mover 26 causes rotation of head shaft 30 resulting in rotation of sprocket 40 to thereby move chain 50 causing endless digging apparatus 20 to rotate to perform an excavation operation. Chain 50 is carried on boom 22 in sliding engagement with upper and lower surfaces 54 and 56 and in rotating engagement with tail shaft 32. Chain 50 includes a plurality of links 60 which are connected by pins 62 which support rollers 64. Chain 50 also includes a plurality of cutter bit assemblies 68.

Figure 3:
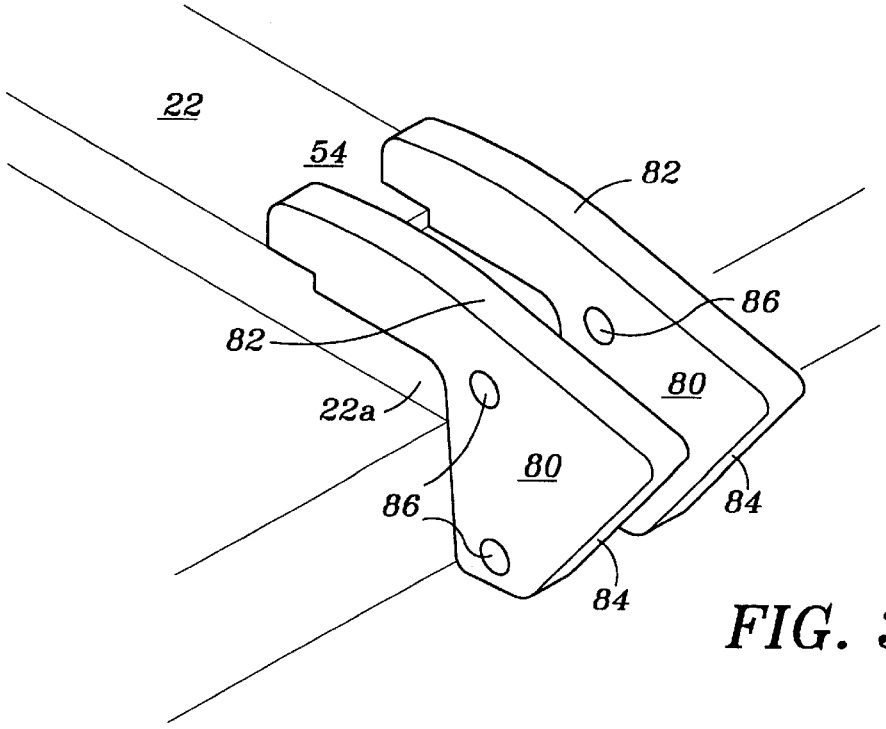
FIG. 3 is a perspective view of a boom inner end illustrating the present wear plates.

Referring to FIGS. 2 and 3, an important aspect of the present invention is the use of a pair of wear plates 80, detachably mounted to inner end 22*a* of boom 20 between end 22*a* and sprocket 40. Wear plates 80 form a transition area to allow chain 50 to move from sprocket 40 to upper surface 54 of boom 22 in a smooth and continuous type motion. Wear plates 80 as more clearly illustrated in FIG. 3 include a top arcuate surface 82 over which rollers 64 move. Ends 84 of wear plates 80 are mounted adjacent to sprocket 40 for initially receiving the lower surface of links 60 as rollers 64 disengage from teeth 42 of sprocket 40. Wear plates 80 include apertures 86 for receiving a threaded pin through boom 22 for detachably mounting wear plates 80 to boom 22. Since wear plates 80 extend above upper surface 54 of boom 22, wear plates 80 function to take up slack in chain 50 as chain 50 rotates around sprocket 40. Wear plates 80 prevent chain 50 from hitting or engaging the corner of upper surface 54 and inner end 22*a* of boom 20 and thereby prevent damage to boom 22 as well as minimizing noise caused by the impact of chain 50 and inner end 22*a* of boom 22. End 84 of wear plates 80 and surface 82 facilitate movement of chain 50 to prevent links 60 from snagging or catching on any edges of boom 22 that may be present. As a result, a smooth and quiet transition takes place as chain 50 rotates about sprocket 40 to upper surface 54 of boom 22.

Wear plates 80 accept wear caused by the friction associated with chain 50 engaging upper surface 54 of boom 22. Wear plates 80 are easily and inexpensively replaceable in the field.

It therefore can be seen that the present wear plates minimize wear on a boom by the chain, and are readily removed and replaceable at minimum cost, thereby increasing the service life of a boom. The present invention further minimizes noise generated as a chain rotates about a sprocket and boom of an excavating machine.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. An excavating machine comprising:

a main frame;

an endless digging chain;

a boom mounted to said main frame and adapted to carry said digging chain, said boom having an upper surface, a lower surface, an inner end and an outer end, said surfaces adapted to slidably engage said chain;

a drive sprocket mounted to said main frame and disposed at said inner end of said boom for engaging said chain; and a wear plate mounted to said boom and disposed between said drive sprocket and said inner end of said boom for slidably engaging said chain between said drive sprocket and said upper surface of said boom inner end.

2. The excavating machine of claim 1 wherein said wear plate includes a top surface for engaging said chain and a bottom surface mounted adjacent to said upper surface of said boom, said top surface being generally arcuate to facilitate sliding and supporting of said chain.

3. The excavating machine of claim 2 wherein said chain includes links connected by pins which support rollers, said rollers engaging said sprocket and said links engaging said wear plate top surface.

4. The excavating machine of claim 1 wherein said wear plate is detachably mounted to said boom.

* * * * *